US008150285B2

(12) United States Patent
Izawa et al.

(10) Patent No.: US 8,150,285 B2
(45) Date of Patent: Apr. 3, 2012

(54) TONER SUPPLIER APPARATUS

(75) Inventors: Hideo Izawa, Sakura (JP); Sumito Mera, Yachiyo (JP); Kotaro Harada, Ichikawa (JP); Seiji Komatsuda, Yokote (JP)

(73) Assignee: Miyakoshi Printing Machinery Co., Ltd. (JP)

( * ) Notice: Subject to any disclaimer, the term of this patent is extended or adjusted under 35 U.S.C. 154(b) by 467 days.

(21) Appl. No.: 12/350,062

(22) Filed: Jan. 7, 2009

(65) Prior Publication Data

US 2009/0175642 A1 Jul. 9, 2009

(30) Foreign Application Priority Data

Jan. 9, 2008 (JP) ..... 2008-002375

(51) Int. Cl.
*G03G 15/10* (2006.01)

(52) U.S. Cl. ..... 399/57; 399/237

(58) Field of Classification Search ..... 399/57, 399/233, 237, 238
See application file for complete search history.

(56) References Cited

U.S. PATENT DOCUMENTS

| | | | | |
|---|---|---|---|---|
| 6,694,112 | B2 * | 2/2004 | Sasaki et al. | 399/57 |
| 2001/0022901 | A1 * | 9/2001 | Suetsugu | 399/57 |
| 2003/0016962 | A1 * | 1/2003 | Teraoka et al. | 399/57 |
| 2003/0175049 | A1 * | 9/2003 | Ichida et al. | 399/237 |

FOREIGN PATENT DOCUMENTS

| | | | |
|---|---|---|---|
| JP | 5-241450 | A | 9/1993 |
| JP | 11-295992 | A | 10/1999 |
| JP | 2001-125383 | A | 5/2001 |
| JP | 2001-142306 | A | 5/2001 |
| JP | 2004-117687 | | 4/2004 |
| JP | 2005-10625 | A | 1/2005 |
| JP | 2007-322685 | A | 12/2007 |

OTHER PUBLICATIONS

Japanese Office Action for Japanese Patent Application No. 2008-002375 mailed Dec. 8, 2009 with English translation.

Office Action for Japanese Application No. 2008-002375 with English translation mailed Mar. 9, 2010.

* cited by examiner

*Primary Examiner* — David Gray
*Assistant Examiner* — Frederick Wenderoth
(74) *Attorney, Agent, or Firm* — Cantor Colburn LLP

(57) ABSTRACT

A toner supplier apparatus 1 is provided for stabilizing the concentration of toner reserved in a main tank. A concentration sensor for measuring the concentration of the toner is provided in a toner-feeding pipeway for supplying liquid toner from a main tank for adjusting the concentration to the developer apparatus. High concentration toner and diluent supplied to the main tank are controlled based on the concentration measured by the concentration sensor. Accordingly, accuracy of the toner supplier apparatus used for an electronic photograph printer in measuring the concentration of the toner can be improved, thereby permitting accurate control for the concentration in a printed image.

2 Claims, 4 Drawing Sheets

TONER SUPPLIER APPARATUS

The present application is based on patent application No. 2008-002375 filed in Japan on Jan. 9, 2008, the content of which is incorporated herein by reference.

BACKGROUND OF THE INVENTION

1. Field of the Invention

The present invention relates to a toner supplier apparatus for supplying a liquid toner to a developer apparatus of a wet type electronic photograph printer using liquid toner.

2. Description of the Related Art

Maintaining the concentration of toner within a fixed range is extremely important in a wet-type electronic photograph printer using liquid toner (hereinafter simply called toner) since the concentration of a printed image depends on the concentration of the toner. A solution proposed in view of this situation is a toner-adjusting apparatus for adjusting the concentration of toner for image development (see for example, Patent Document 1)

The Patent Document 1 discloses a toner-adjusting apparatus including: a toner reservoir for adjusting the concentration of a toner (a back-up toner reservoir described in the Patent Document 1); a diluent-supplier section for supplying diluent to the toner reservoir; and a high-concentration-toner-supplier section for supplying a high concentration toner to the toner reservoir. In this configuration, the concentration-controlled toner is fed from the toner reservoir to a toner chamber (a toner reservoir 37B as shown in FIG. 2 of the Patent Document 1) for supplying the toner onto the developing roll. In addition, a toner-feedback pipeway extending from the toner chamber is connected to the toner reservoir so that the toner fed back to the toner reservoir is circulated and supplied to the toner chamber.

The concentration of the reserved toner, while being supplied from the toner chamber via the developing roll onto the photosensitive drum making contact with the developing roll, varies since consumption rates of the diluent and toner grains vary based on the size, density, and concentration of a printed image.

To address this situation, the toner-adjusting apparatus in an attempt to stabilize the concentration of the toner reserved in the toner chamber controls the concentration of the toner reserved in the toner reservoir within a fixed range while liquids are supplied from the diluent-supplier section and the high-concentration-toner-supplier section to the toner reservoir and while the liquid is supplied from the toner reservoir to a toner chamber in the vicinity of the developing roll. In addition, the surface level of the liquid reserved in the toner reservoir is maintained within a fixed range by such liquid flow control.

Patent Document 1: Japanese Unexamined Patent Application, First Publication No. 2004-117687

However, the toner-adjusting apparatus described in the aforementioned Patent Document 1 has the following disadvantages (a) to (c).

(a) A concentration sensor is provided in a bottom section of the toner reservoir for controlling the concentration of the toner reserved in the toner reservoir. However, accuracy may be lowered for controlling the toner concentration since the concentration of the toner measured by the concentration sensor is vulnerable to the toner dispersed in the toner reservoir. For example, when the toner is not dispersed in the toner reservoir uniformly, particularly in a case immediately after stirring the toner, a concentration of the toner reserved in the toner reservoir and measured by the concentration sensor may differ from the concentration of the toner reserved in the toner chamber in the vicinity of the developer apparatus.

(b) There is a time-lag until the concentration of the toner reserved in the toner chamber of the developer apparatus reaches to the concentration of the toner reserved in the toner reservoir via toner-supplying pipeways and valves.

(c) The measured concentration tends to include an error because the concentration sensor of the aforementioned type measuring an attenuation rate of an ultrasonic wave transmitting in the liquid toner do not consider the temperature characteristics of a transmitter/receiver section thereof. For example, the temperature of the toner increases based on friction at a roller nip causes the transmitter section to emit a more significant signal than the true temperature, and accordingly causes the receiver section to receive a more significant level of the signal, thereby resulting a lower concentration being obtained than the true concentration.

SUMMARY OF THE INVENTION

An object of the present invention in view of the aforementioned objects is to provide a toner-adjusting apparatus, used for an electronic photograph printer, which can improve accuracy in measuring the concentration of toner and enabling accurate control for concentration in a printed image.

In order to solve the aforementioned objects, the present invention provides a toner supplier apparatus for supplying liquid toner to a developer apparatus of an electronic photograph printer. The toner supplier apparatus includes: a main tank for adjusting the concentration of the liquid toner; a high-concentration-toner-supplier section for supplying high concentration toner to the main tank; a diluent-supplier section for supplying diluent to the main tank; a toner-feeding pipeway for supplying the liquid toner from the main tank to the developer apparatus; a concentration sensor, provided in a toner-feeding pipeway, for measuring the concentration of the liquid toner in the toner-feeding pipeway; and a controller apparatus for controlling the diluent supplied from the diluent-supplier section to the main tank and for controlling the high concentration toner supplied from the high-concentration-toner-supplier section to the main tank based on the concentration measured by the concentration sensor and for maintaining the liquid toner at a preset concentration in the main tank.

In addition, the present invention provides the toner supplier apparatus further including a temperature controller apparatus provided in the vicinity of the main tank.

In addition, the present invention provides the toner supplier apparatus further including: a toner reservoir provided in the developer apparatus; and a toner-feedback pipeway for feeding the toner back from the toner reservoir to the main tank so that, the main tank has an elongated shape; the diluent-supplier section, the high-concentration-toner-supplier section, and the toner-feedback pipeway are connected to one of the two ends in a longitudinal direction of the main tank; and the toner-feeding pipeway is connected to the other end of the main tank.

Effects of the Invention

The toner supplier apparatus according to the present invention enabling more accurate control for the concentration of the toner using the concentration sensor than in a conventional case, thereby resulting in an improvement in the accuracy in measuring the concentration of the toner reserved in the main tank because the toner supplier apparatus is configured to control the concentration of the liquid toner (also simply called toner) reserved in the main tank by supplying the high concentration toner from the high-concentration-toner-supplier section to the main tank and by supplying the diluent from the diluent-supplier section to the main tank based on the concentration of the toner measured by the concentration sensor provided in the toner-feeding pipeway. This facilitates the stable control for the concentration of the toner reserved in the main tank more significantly than in a conventional case, and provides accurate control for the concentration in a printed image.

In addition, the temperature controller apparatus provided in the vicinity of the main tank can restrict an increase of the temperature of the toner and reduce the occurrence of error in the concentration measured by means of the concentration-measuring sensor using an ultrasonic wave.

BRIEF DESCRIPTION OF THE DRAWINGS

FIG. 3A is a view taken from a side providing connection ports (bottom surface), and FIG. 3B is a cross section showing the mechanism of the concentration sensor.

DETAILED DESCRIPTION OF THE INVENTION

An example of the toner supplier apparatus as an implementation of the present invention will be explained as follows with reference to drawings.

Figure 1:
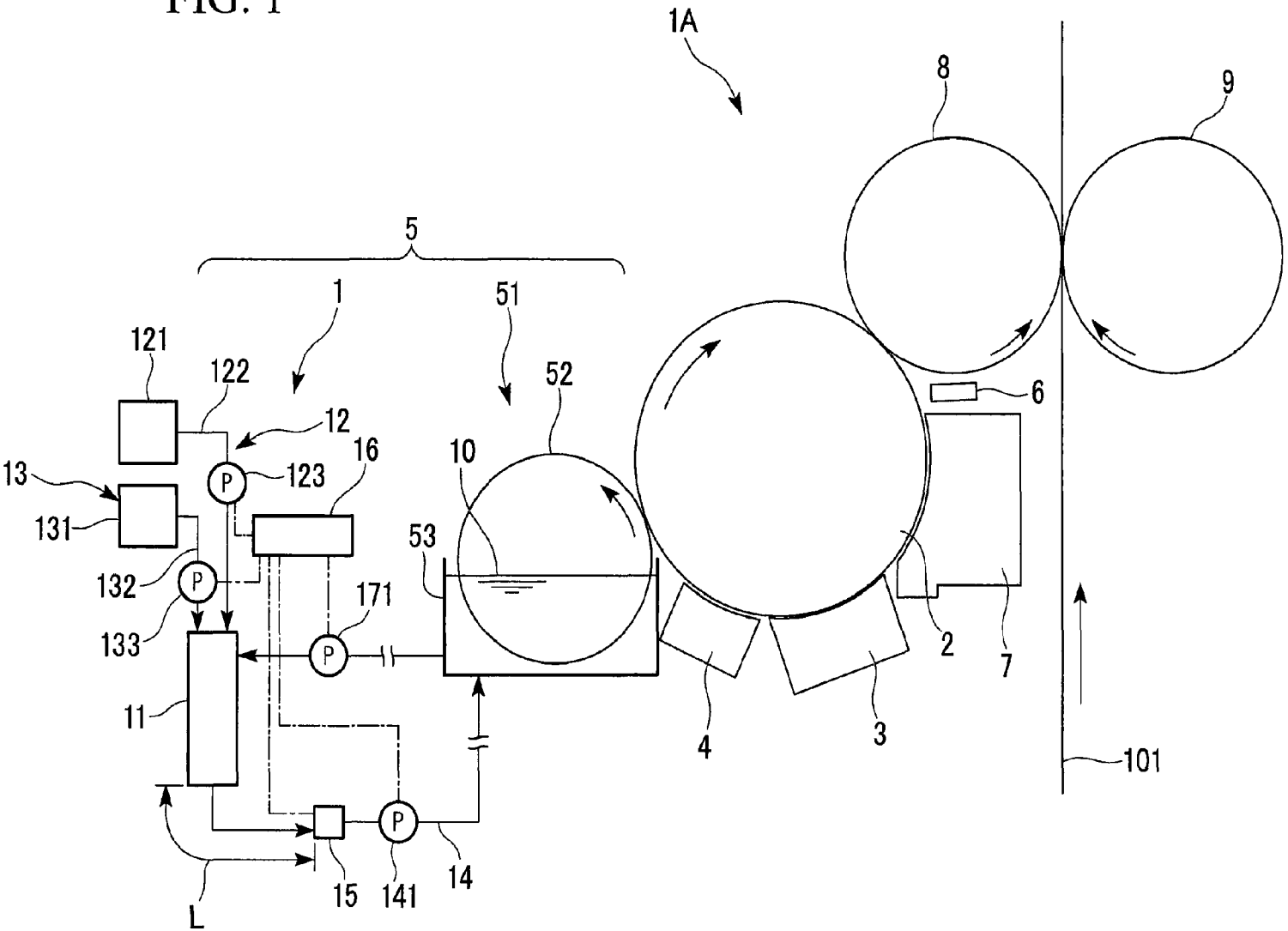
FIG. 1 is a front elevation showing an embodiment of a toner supplier apparatus according to the present invention and showing the configuration of an electronic photograph printer adopting a toner supplier apparatus.
Figure 2:
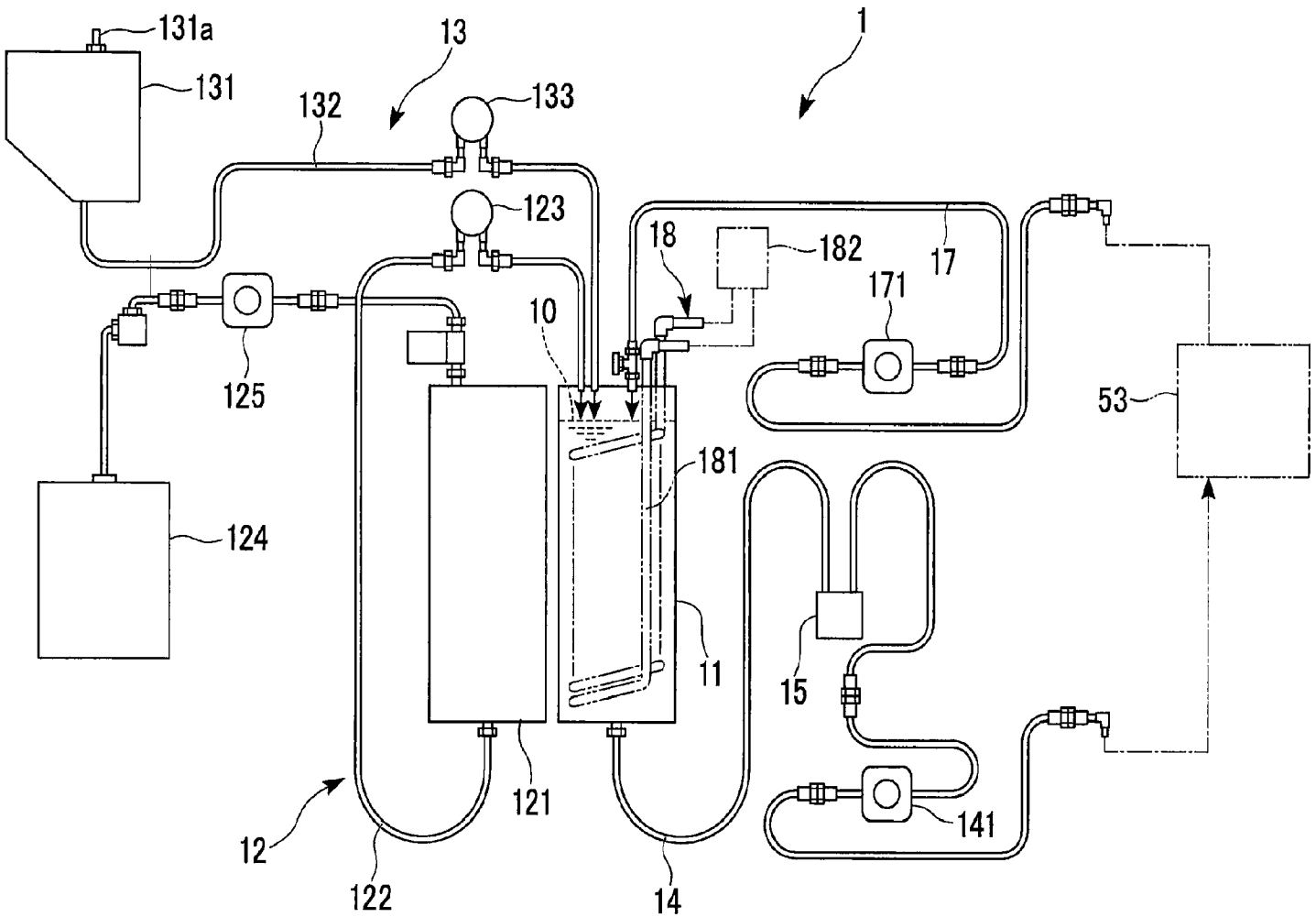
FIG. 2 shows the toner supplier apparatus shown in FIG. 1.
Figure 3A:
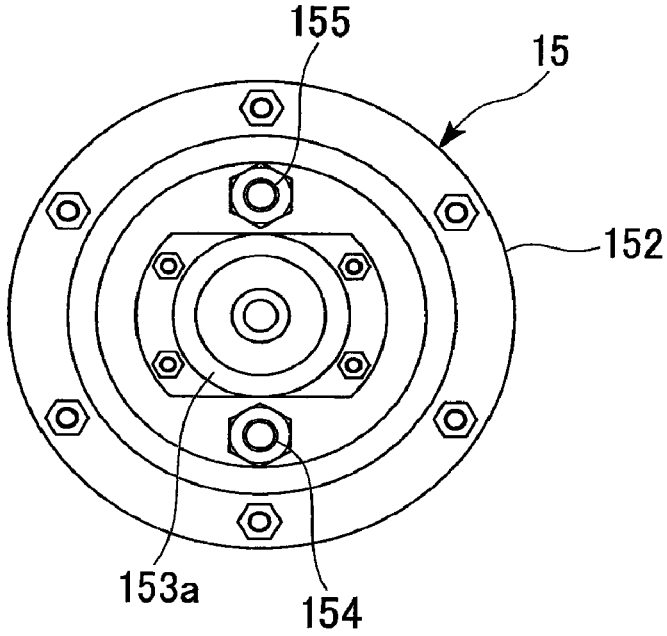
FIGS. 3A and 3B show an example of a concentration sensor of the toner supplier apparatus shown in FIG. 1.
Figure 3B:
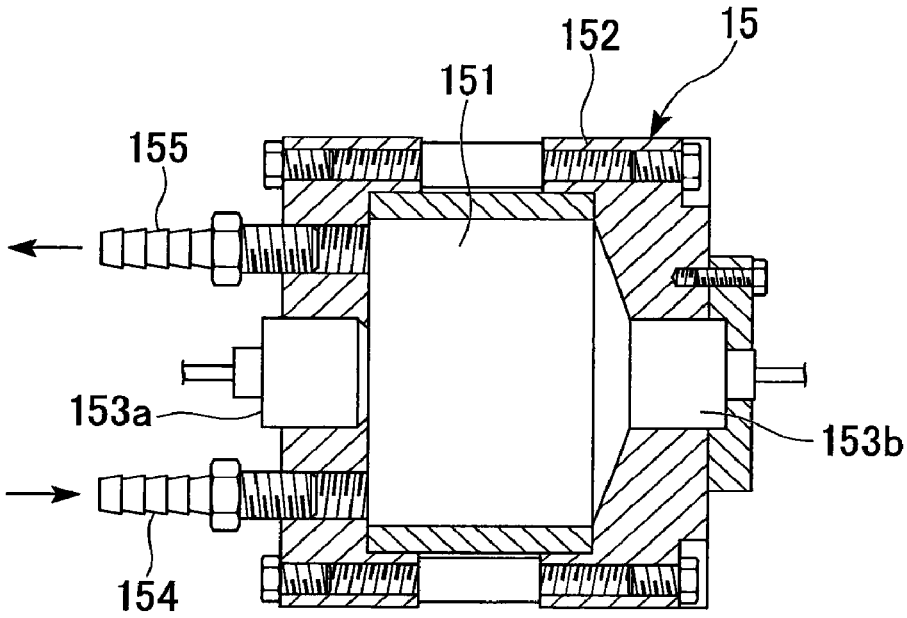

FIG. 1 is a front elevation showing the configuration of an electronic photograph printer 1A adopting a toner supplier apparatus 1 according to the present invention. FIG. 2 is a general view showing the configuration of the toner supplier apparatus 1. FIGS. 3A and 3B show an example of the structure of a concentration sensor adopted in the toner supplier apparatus 1.

FIG. 1 shows the configuration of the electronic photograph printer 1A including: a photosensitive drum 2; a static-charging apparatus 3; an exposure apparatus 4; a developer apparatus 5; a static-eliminating apparatus 6; a photosensitive-material cleaner 7; a transfer roll 8; and a backup roller 9. The toner supplier apparatus 1 is provided in the developer apparatus 5.

Reference numeral 101 in FIG. 1 indicates a recording paper. A swathe of the elongated recording paper 101 is placed between the transfer roll 8 and the backup roll 9. The rotatable transfer roll 8 and the backup roll 9 may have a function of feed roll for feeding the recording paper 101.

A drive apparatus, not shown in the drawing, drives the photosensitive drum 2 rotatably supported by the frame, not shown in the drawing, of the electronic photograph printer 1A. The photosensitive drum 2 rotates relative to the recording paper 101.

The static-charging apparatus 3 causes the surface of the photosensitive drum 2 to be charged uniformly.

The exposure apparatus 4 removes the charges, statically charged on the surface of the photosensitive drum 2 by the static-charging apparatus 3, by means of exposure and forms a static latent image. The exposure apparatus 4 removes charges from at least a part of the surface of the photosensitive drum 2 by means of exposure.

The developer apparatus 5 includes a developer apparatus 51 and the toner supplier apparatus 1. The developer apparatus 51 has a rotatable developing roll 52 making contact with the photosensitive drum 2 and a toner reservoir 53.

The developer apparatus 5 supplies toner onto the photosensitive drum 2 via the developing roll 52 to form a toner image on the surface of the photosensitive drum 2 by visualizing the static latent image.

The configurations of the developer apparatus 51 and the toner supplier apparatus 1 will be explained later.

The static-eliminating apparatus 6 eliminates charges fully from the surface of the photosensitive drum 2.

The photosensitive-material cleaner 7 cleans the surface of the photosensitive drum 2 by removing objects (toner or the like) sticking to the surface of the photosensitive drum 2.

The rotative transfer roll 8 transfers the toner image formed on the surface of the photosensitive drum 2 onto the recording paper 101 while making contact with the photosensitive drum 2.

The backup roll 9 ensures that the transfer roll 8 applies a pressing force to the recording paper 101 while placing the recording paper 101 between the backup roll 9 and the transfer roll 8.

The developer apparatus 51 of the developer apparatus 5 visualizes the static latent image formed on the photosensitive drum 2 by adhering toner 10 supplied from the toner supplier apparatus 1 to the toner reservoir 53 onto the surface of the developing roll 52 uniformly, and by causing the toner 10 to be statically charged from the developing roll 52 onto the static latent image formed on the photosensitive drum 2 making contact with the developing roll 52.

The developer apparatus 51 configured to have the lower part of the developing roll 52 dipped in the toner 10 reserved in the toner reservoir 53 is not limited to the configuration schematically shown in FIG. 1 and may adopt another configuration in which, for example, the toner 10 is supplied to the developing roll 52 via a toner supplier roll dipped in the toner 10 reserved in the toner reservoir 53.

Next, the toner supplier apparatus 1 will be described.

As shown in FIGS. 1 and 2, the toner supplier apparatus 1 is configured to include a main tank 11 for adjusting the concentration of the toner; a high-concentration-toner-supplier section 12 for supplying high concentration toner to the main tank 11; a diluent-supplier section 13 for supplying diluent to the main tank 11; a concentration sensor 15, provided in a toner-feeding pipeway 14 provided between the main tank 11 and the toner reservoir 53 of the developer apparatus 51, for measuring the concentration of the toner flowing in the toner-feeding pipeway 14; and a controller apparatus 16 for controlling the diluent supplied from the diluent-supplier section 13 to the main tank 11 and controlling the high concentration toner supplied from the high-concentration-toner-supplier section 12 to the main tank 11 based on the concentration measured by the concentration sensor 15.

The high-concentration-toner-supplier section 12 includes a high-concentration-toner-reservoir chamber 121 (sub-concentrated-toner tank) for reserving the high concentration liquid toner (toner in an undiluted form); a liquid-feed pipeway 122 provided between the high-concentration-toner-reservoir chamber 121 and the main tank 11; and a pump 123 provided in the liquid-feed pipeway 122 for feeding the high concentration toner from the high-concentration-toner-reservoir chamber 121 to the main tank 11.

In the drawing, reference numeral 124 indicates a concentrated toner pack and reference numeral 125 indicates a pump. The high concentration toner can be replenished to the high-concentration-toner-reservoir chamber 121 from the concentrated toner pack 124 via the pump 125.

The diluent-supplier section 13 includes a diluent-reservoir chamber 131; a liquid-feedback pipeway 132 provided between the diluent-reservoir chamber 131 and the main tank 11; and a pump 133 provided in the liquid-feed pipeway 132 for feeding the diluent from the diluent-reservoir chamber 131 to the main tank 11.

In addition, if necessary, a carrier-liquid pack may be provided through which the diluent can be replenished into a connection port 131*a* provided on the diluent-reservoir chamber 131.

A pump 141 for feeding the toner reserved in the main tank 11 to the toner reservoir 53 is provided in the toner-feeding pipeway 14 provided between the main tank 11 and the toner reservoir 53.

In addition, reference numeral 17 indicates a toner-feedback pipeway for feeding back the toner from the toner reservoir 53 to the main tank 11. A pump 171 provided in the toner-feedback pipeway 17 feeds the toner existing in the toner-feedback pipeway 17 between the main tank 11 and the toner reservoir 53 back to the main tank 11.

The toner supplier apparatus 1 (more specifically, the main tank 11), the toner-feeding pipeway 14, the toner reservoir 53, and the toner-feedback pipeway 17 constitute a recyclable toner-supplying system in which the toner previously fed from the main tank 11 via the toner-feeding pipeway 14 to the toner reservoir 53 of the developer apparatus 51 is fed back from the toner reservoir 53 via the toner-feedback pipeway 17 to the main tank 11; and the toner having concentration further adjusted in the main tank 11 is fed to the toner reservoir 53 of the developer apparatus 51 via the toner-feeding pipeway 14.

The concentration of the toner in the main tank 11 is adjusted based on the quantity of the high concentration toner fed from the high-concentration-toner-supplier section 12 and on the quantity of the diluent fed from the diluent-supplier section 13.

The concentration of the toner reserved in the main tank 11 is maintained lower than that of the toner reserved in the high-concentration-toner-reservoir chamber 121 of the high-concentration-toner-supplier section 12.

The controller apparatus 16 controls the high-concentration-toner-supplier section 12 and the diluent-supplier section 13 so that the concentration and the liquid level of the toner reserved in the main tank 11 can be maintained in stable conditions.

The controller apparatus 16 controls the diluent-supplier section 13 and the high-concentration-toner-supplier section 12 while the feeding of the diluent fed from the diluent-reservoir chamber 131 to the main tank 11 and the feeding of the high concentration toner fed from the high-concentration-toner-reservoir chamber 121 to the main tank 11 are based on the concentration measured by the concentration sensor 15.

The controller apparatus 16 controls the feeding of the high concentration toner from the high-concentration-toner-reservoir chamber 121 to the main tank 11 by controlling the driving condition of the pump 123 of the high-concentration-toner-supplier section 12.

The controller apparatus 16 controls the feeding of the diluent fed from the diluent-reservoir chamber 131 to the main tank 11 by controlling the driving condition of the pump 133 of the diluent-supplier section 133.

The controller apparatus 16 further controls the toner supplier apparatus 1 so that the high concentration toner is supplied from the high-concentration-toner-supplier section 12 to the main tank 11 upon detecting a lower concentration than a preset concentration obtained by means of the concentration sensor 15; and the diluent is supplied from the diluent-supplier section 13 to the main tank 11 upon detecting a higher concentration than a preset concentration obtained by means of the concentration sensor 15. Accordingly, the concentration of the toner reserved in the main tank 11 is maintained in a stable condition.

In addition, the liquid level of the liquid toner reserved in the main tank 11 is maintained in a stable condition by controlling the high-concentration-toner-supplier section 12 and the diluent-supplier section 13, more specifically, by controlling the feeding rate of the high concentration toner from the high-concentration-toner-supplier section 12 to the main tank 11 and the feeding rate of the diluent from the diluent-supplier section 13 to the main tank 11. A continuously stable liquid level will contribute to stabilize the feeding rate of the toner flowing in the toner-feeding pipeway 14.

The toner 10 reserved in the toner reservoir 53 of the developer apparatus 51 is consumed while the toner 10 is supplied to the photosensitive drum 2 via the developing roll 52 making contact with the photosensitive drum 2. Consumption rates for the diluent and the toner grains are variable based on the number, size, density, and concentration of a printed image. For example, the toner grains are consumed in a somewhat higher degree if a printed image has a somewhat larger size and has a somewhat significant concentration; and in contrast, the diluent is consumed in a somewhat higher degree if a printed image has a somewhat smaller size and if a fewer number of image are printed.

If the consumption rates of the diluent and the toner grains fluctuate, the concentration of the toner fed back from the toner reservoir 53 via the toner-feedback pipeway 17 to the main tank 11 fluctuates inevitably. However, the toner supplier apparatus 1 maintains the toner reserved in the main tank 11 in a stable condition by means of the controller apparatus 16 which controls the high concentration toner fed from the high-concentration-toner-supplier section 12 to the main tank 11 and the diluent fed from the diluent-supplier section 13 to the main tank 11. Therefore, the concentration of the toner reserved in the toner reservoir 53 can be maintained in a stable condition while the toner is fed from the main tank 11 via the toner-feeding pipeway 14 to the toner reservoir 53 of the developer apparatus 51. Consequently, accurate control of the concentration in a printed image can be achieved.

Preferably, the concentration sensor 15 is provided as upstream as possible with respect to the feeding direction of the toner in the toner-feeding pipeway 14. Accordingly, the fluctuation of the concentration of the toner reserved in the main tank 11 can be detected promptly. If the position of the concentration sensor 15 provided in the toner-feeding pipeway 14 is close to that of the main tank 11 to shorten the length of the flowpath (length of the pipeway) provided between the main tank 11 to the concentration sensor 15, quick response can be achieved corresponding to the fluctuation of the concentration of the toner reserved in the main tank 11 by controlling the high concentration toner fed from the high-concentration-toner-supplier section 12 to the main tank 11 and the diluent fed from the diluent-supplier section 13 to the main tank 11 based on the concentration measured by the concentration sensor 15 of the controller apparatus 16. Therefore, this configuration contributes to stabilization of the concentration of the toner reserved in the main tank 11 effectively.

In the drawing, the concentration sensor 15 is provided upstream relative to the pump 141.

The concentration sensor 15 used here is an ultrasonic concentration sensor.

As shown in FIG. 3B, the concentration sensor 15 includes an enclosure 152 having a concentration detection chamber 151 into which the liquid toner flowing in the toner-feeding pipeway 14 is introduced; and ultrasonic-wave-transmitters/receivers 153*a* and 153*b* attached to the enclosure 152 while being opposed to each other so that the concentration detection chamber 151 is placed therebetween. The concentration sensor 15 measures the concentration of the toner by measuring the attenuation rate of an ultrasonic wave transmitted from one of the ultrasonic-wave-transmitters/receivers 153*a* and 153*b* (in this case, reference numeral 153*a* indicates the transmitter, and reference numeral 153*b* indicates a receiver) through the liquid toner in the concentration detection chamber 151.

In FIGS. 3A and 3B, reference numerals 154 and 155 indicate connection ports connected with the toner-feeding pipeway 14. The reference numeral 154 indicates an input connection port, and the reference numeral 155 indicates an output connection port. The input connection port 154 and the output connection port 155 communicate with the concentration detection chamber 151 respectively.

The concentration sensor 15 is provided in the toner-feeding pipeway 14 by connecting the toner-feeding pipeway 14 to the input connection port 154 and to the output connection port 155.

That is, the concentration sensor 15 is in in-line connection with the toner-feeding pipeway 14. The piping of the toner-feeding pipeway 14 extending from the concentration sensor 15 to the main tank 11 is connected to the input connection port 154, and the piping of the toner-feeding pipeway 14 extending from the concentration sensor 15 to the developer apparatus 51 is connected to the output connection port 155. Accordingly, the toner introduced into the input connection port 154 can be drained from the output connection port 155 via the concentration detection chamber 151.

As show in FIG. 2, the main tank 11 has a temperature controller apparatus 18 for maintaining the preset temperature of the toner reserved in the main tank 11.

The temperature of the toner introduced from the main tank 11 into the toner-feeding pipeway 14 can be stabilized by means of the temperature controller apparatus 18. The sensitivity of the ultrasonic concentration sensor 15, which is normally vulnerable to the fluctuation of temperature, can be maintained in a stable state by means of the temperature controller apparatus 18 for stabilizing the temperature of the toner introduced into the concentration sensor 15. Therefore, keeping track of the variable sensitivity of the concentration sensor 15 with respect to the fluctuation of the temperature of the toner introduced thereinto enables accurate measurement for the concentration and improves the accuracy of the measured concentration.

More specifically, as shown in FIG. 2, the temperature controller apparatus 18 is configured so that the temperature of the toner reserved in the main tank 11 is stabilized by continuously flowing a fixed temperature of water through a water pipeway 181 (heat-exchanging section) disposed spirally in the main tank 11 by means of a circulator apparatus 182 having a temperature controller.

This configuration can prevent the temperature of the toner reserved in the main tank 11 from increasing after the toner heated by the photosensitive drum 2 or by the roller nip of the developing roll 52 having friction with the photosensitive drum 2 returns from the toner-feedback pipeway 17 into the main tank 11.

Not to mention that the temperature controller apparatus 18 is not limited to the a water-flow type, the temperature controller apparatus 18 can adopt various configurations.

In addition, the liquid level of the liquid toner reserved in the main tank 11 that is maintained in a stable condition will contribute to stabilize the toner reserved in the main tank 11 effectively by controlling the high-concentration-toner-supplier section 12 and the diluent-supplier section 13, more specifically, by controlling the feeding rate of the high concentration toner from the high-concentration-toner-supplier section 12 to the main tank 11 and the feeding rate of the diluent from the diluent-supplier section 13 to the main tank 11.

As shown in the drawing, the main tank 11 has an elongated cylindrical shape (more specifically, vertically-oriented elongated shape in the drawing). Connected to one of the two ends in the longitudinal direction (in the drawing, to an upper end section thereof) are the pipeway 122 of the high-concentration-toner-supplier section 12, the pipeway 132 of the diluent-supplier section 13, and the toner-feedback pipeway 17. The toner-feeding pipeway 14 is connected to the other end of the main tank 11 in the longitudinal direction (a lower end in the drawing). The heat-exchanging section (i.e., the water pipeway 181 in the drawing) of the temperature controller apparatus 18 is provided, not to the vicinity of one of the end of the main tank 11 in the longitudinal direction, over substantially the full length in the longitudinal direction in the vicinity of the main tank.

The liquids received at the upper end section of the main tank 11 in the longitudinal direction are the toner supplied from the high-concentration-toner-supplier section 12 through the pipeway 122, the diluent supplied from the diluent-supplier section 13 through the pipeway 132, and the toner supplied to the main tank 11 through the toner-feedback pipeway 17. The toner 10 reserved in the main tank 11 and existing in the vicinity of the lower end section in the longitudinal direction of the main tank 11 is first fed to the developer apparatus 51 through the toner-feeding pipeway 14, and the toner 10 is fed out successively. This causes a substantial uni-directional flow of the toner from the upper end to the lower end of the main tank 11. The toner supplied from the high-concentration-toner-supplier section 12 through the pipeway 122, the diluent supplied from the diluent-supplier section 13 through the pipeway 132, and the toner supplied to the main tank 11 through the toner-feedback pipeway 17 that are received at the upper end section of the main tank 11 in the longitudinal direction undergo sufficient temperature control conducted by the temperature controller apparatus 18 while being flown from the upper end section to the lower end section of the main tank 11 in the longitudinal direction.

In addition, the toner moving along a significant length in the main tank 11 allows the toner grains to be dispersed in the toner 10, thereby stabilizing the concentration of the toner introduced into the toner-feeding pipeway 14 from the main tank 11. Furthermore, the toner moving along a significant length from the main tank 11 to the concentration sensor 15 in the toner-feeding pipeway 14 promotes the dispersion of the toner grains in the toner. This also contributes to an improvement of the accuracy of the concentration sensor 15 for measuring the concentration of the toner.

The significant length of a flowpath (pipeway length L, see FIG. 1) of the toner-feeding pipeway 14 obtained between the main tank 11 and the concentration sensor 15 contributes to dispersion of the toner grains effectively. Alternatively, the length of the pipeway length L can be shortened by obtaining a significant length of moving distance for the toner in the main tank 11.

It should be noted that the main tank 11 shown in the drawing and being free from a toner-stirring apparatus may have a stirring apparatus. Accordingly, the concentration of the toner introduced into the toner-feeding pipeway 14 from the main tank 11 can be stabilized more significantly. In addition, this contributes to shortening of the length of a pathway (pipeway length L) of the toner-feeding pipeway 14 effectively between the main tank 11 and the concentration sensor 15.

As previously explained, the toner supplier apparatus 1 allows the concentration sensor 15 to measure an accurate concentration of the toner, thereby resulting in improved accuracy of controlling the concentration of the toner reserved in the main tank 11. This facilitates the stable control for the concentration of the toner reserved in the main tank 11 more significantly than in a conventional case, and provides accurate control of the concentration in a printed image.

In addition, a reduced degree of increase in the concentration of the toner will help reduce errors when measuring the concentration of the toner using the concentration sensor 15.

Although the present invention has been described with respect to its preferred embodiments, the present invention is not limited to the embodiments described above. The configuration of the present invention allows for addition, omission, substitution and further modification without departing from the spirit and scope of the present invention.

Figure 4:
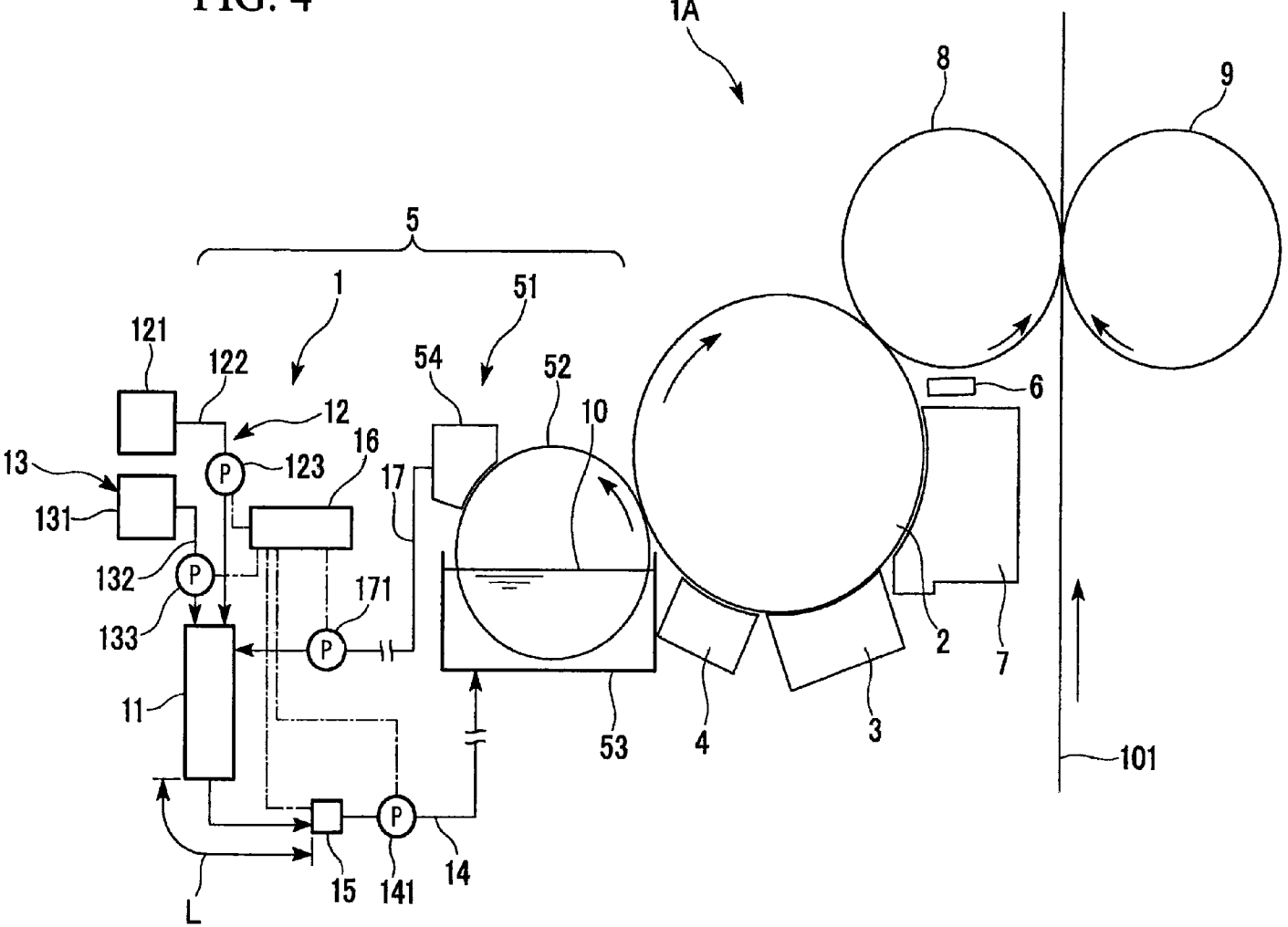
FIG. 4 shows the toner supplier apparatus and the electronic photograph printer adopting the toner supplier apparatus that are configured so that the toner is fed back to a main tank via a toner-feedback pipeway that is connected to a developing-roll cleaner for collecting the toner adhering on the developing roll

The present invention is not limited to the configuration of the recyclable toner-supplying system as shown in FIG. 1 assembled by connecting the toner-feeding pipeway 14 and the toner-feedback pipeway 17 to the toner reservoir 53 of the developer apparatus 51. For example, FIG. 4 shows the developer apparatus 51 which has a developing-roll cleaner 54, in addition to the toner reservoir 53 for supplying the toner to the developing roll 52, for collecting the toner sticking to the developing roll 52. The developing-roll cleaner 54 is provided downstream in the rotational direction of the developing roll 52 relative to the point where the developing roll 52 makes contact with the photosensitive drum 2 and is provided upstream in the rotational direction relative to the toner reservoir 53. In this configuration, the toner-feedback pipeway 17 may be connected to the 54 to feed back the toner collected from the developing roll 52 to the main tank 11 through the toner-feedback pipeway 17.

This case is advantageous in stabilizing the concentration of the toner reserved in the toner reservoir 53 because the toner consumption accompanying a printing operation and the consumption rates of the diluent and the toner grains have no effect on the concentration of the toner reserved in the toner reservoir 53 while the static latent image formed on the photosensitive drum 2 is developed (visualized) by using the toner.

What is claimed is:

1. A toner supplier apparatus for supplying liquid toner to a developer apparatus of an electronic photograph printer, the developer apparatus comprising a toner reservoir, the toner supplier apparatus comprising:

a main tank for adjusting concentration of the liquid toner;

a high-concentration-toner-supplier section for supplying high concentration toner to the main tank;

a diluent-supplier section for supplying diluent to the main tank;

a toner-feeding pipeway for supplying the liquid toner from the main tank to the developer apparatus;

a concentration sensor, provided in a toner-feeding pipeway, for measuring the concentration of the liquid toner existing in the toner-feeding pipeway;

a controller apparatus for controlling the diluent supplied from the diluent-supplier section to the main tank and controlling the high concentration toner supplied from the high-concentration-toner-supplier section to the main tank based on the concentration measured by the concentration sensor, and for maintaining the liquid toner at a preset concentration in the main tank;

a toner reservoir provided at the developer apparatus;

a temperature controller apparatus provided inside the main tank;

a toner-feedback pipeway for feeding the toner back from the toner reservoir to the main tank, wherein the main tank has an elongated shape, the diluent-supplier section, the high-concentration-toner-supplier section, and the toner-feedback pipeway are connected to one of the two ends in a longitudinal direction of the main tank, and the toner-feeding pipeway is connected to the other end of the main tank.

2. The toner supplier apparatus according to claim 1, further comprising:

a water pipeway of the temperature controller apparatus provided over substantially the full length in the longitudinal direction inside the main tank.

* * * * *